US010710207B2

(12) United States Patent
Bukkapatnam et al.

(10) Patent No.: US 10,710,207 B2
(45) Date of Patent: Jul. 14, 2020

(54) METHOD AND APPARATUS FOR PERFORMING TARGETED POLISHING VIA MANIPULATION OF MAGNETIC-ABRASIVE FLUID

(71) Applicant: The Texas A&M University System, College Station, TX (US)

(72) Inventors: Satish Bukkapatnam, College Station, TX (US); Arun Srinivasa, College Station, TX (US); Wayne N. p. Hung, College Station, TX (US); Asif Iquebal, College Station, TX (US); Thiagarajan Nagarajan, Houston, TX (US); Matthew Remy Aguirre, College Station, TX (US); Kaitlyn Graham, College Station, TX (US)

(73) Assignee: The Texas A&M University System, College Station, TX (US)

( * ) Notice: Subject to any disclaimer, the term of this patent is extended or adjusted under 35 U.S.C. 154(b) by 171 days.

(21) Appl. No.: 15/236,004

(22) Filed: Aug. 12, 2016

(65) Prior Publication Data

US 2017/0043448 A1 Feb. 16, 2017

Related U.S. Application Data

(60) Provisional application No. 62/205,257, filed on Aug. 14, 2015.

(51) Int. Cl.
*B24B 31/112* (2006.01)
*B24B 1/00* (2006.01)

(52) U.S. Cl.
CPC ..... *B24B 31/112* (2013.01); *B24B 1/005* (2013.01)

(58) Field of Classification Search
CPC ..... B24B 31/102; B24B 31/112; B24B 1/005
USPC ..... 451/36, 113, 35
See application file for complete search history.

(56) References Cited

U.S. PATENT DOCUMENTS 2,973,606 A * 3/1961 Brandt ..... B24B 31/06 241/171
3,248,826 A * 5/1966 Van Fossen ..... B24B 31/06 366/128
3,533,928 A * 10/1970 Inoue ..... B23H 9/02 204/155
3,589,071 A * 6/1971 Hirschhorn ..... B24B 1/00 451/113

(Continued)

FOREIGN PATENT DOCUMENTS

WO WO-2015/019661 A1 2/2015

OTHER PUBLICATIONS

El-Amri, Iskander et al.; "Localized magnetic fluid finishing of freeform surfaces using electropermanent magnets and magnetic concentration"; Journal of Manufacturing Processes; 2018; 7 pages.

(Continued)

*Primary Examiner* — Eileen P Morgan
*Assistant Examiner* — Marcel T Dion
(74) *Attorney, Agent, or Firm* — Winstead PC

(57) ABSTRACT

A magnetic field manipulated localized polishing system includes a container holding a volume of a magnetic abrasive fluid. The magnetic abrasive fluid contains abrasive particles. A motor is positioned under the container. A magnet is coupled to the motor such that the motor induces rotation of the magnet. A workpiece is suspended in the container.

18 Claims, 5 Drawing Sheets

(56) References Cited

U.S. PATENT DOCUMENTS 3,637,190 A * 1/1972 Isaacson ..... B01F 11/0094 366/111
3,776,827 A 12/1973 Inoue
4,074,466 A 2/1978 Rampe
4,280,302 A * 7/1981 Ohno ..... B24B 31/0224 451/113
5,040,336 A * 8/1991 Ahern ..... B24B 7/228 451/113
5,211,673 A * 5/1993 Ditscherlein ..... B24B 31/108 451/113
5,384,989 A * 1/1995 Shibano ..... B24B 1/04 451/104
5,611,725 A 3/1997 Imahashi
6,227,942 B1 5/2001 Hoffman
6,468,358 B1 * 10/2002 Courson ..... B08B 7/0092 134/30
6,672,948 B2 * 1/2004 Mizuno ..... B24B 9/146 451/255
7,874,897 B2 * 1/2011 Marshall, Jr. ..... B24B 29/00 451/113
8,801,498 B2 * 8/2014 Hammond ..... B24B 31/108 451/104
2003/0087585 A1 * 5/2003 Kordonsky ..... B24B 1/005 451/5
2010/0159808 A1 6/2010 Shimodaira et al.
2013/0225049 A1 * 8/2013 Shorey ..... B24B 31/00 451/36
2016/0176008 A1 * 6/2016 Maeda ..... B24B 31/02 451/32

OTHER PUBLICATIONS

Chegdani, Faissal et al.; "Multiscale tribo-mechanical analysis of natural fiber composites for manufacturing applications"; Tribology International; vol. 122; 2018; pp. 143-150.
Bukkapatnam, Satish T.S. et al.; "Planar random graph representations of spatiotemporal surface morphology: Application to finishing of 3-D printed components"; CIRP Annals—Manufacturing Technology; vol. 67; 2018; pp. 495-498.
Iquebal, Ashif Sikandar et al.; "Longitudinal Milling and Fine Abrasive Finishing Operations to Improve Surface Integrity of Metal AM Components"; Procedia Manufacturing; vol. 10; 2017; pp. 990-996.
Iquebal, Ashif S. et al.; "Surface plastic flow in polishing of rough surfaces"; arXiv:1610.09719v2 [cond-mat.mtrl-sci]; Mar. 31, 2017; 20 pages.

* cited by examiner

METHOD AND APPARATUS FOR PERFORMING TARGETED POLISHING VIA MANIPULATION OF MAGNETIC-ABRASIVE FLUID

CROSS-REFERENCE TO RELATED APPLICATIONS

This applications claims priority to, and incorporates by reference for any purpose the entire disclosure of, U.S. Provisional Patent Application No. 62/205,257, filed on Aug. 14, 2015.

STATEMENT REGARDING FEDERALLY SPONSORED RESEARCH AND DEVELOPMENT

This invention was made with government support under Grant No. 1437139 awarded by the National Science Foundation. The government has certain rights in the invention.

BACKGROUND

Field of the Invention

The present application relates generally to polishing of surfaces and more particularly, but not by way of limitation, to polishing of freeform external and internal surfaces via manipulation of magnetic-abrasive fluid.

History of the Related Art

Hand held buffers and polishers are commonly utilized in applications requiring localized polishing. Use of such equipment, however, demands dexterity and is highly tedious. As an alternative approach, electrochemical and electromechanical etching methods have been investigated and utilized in the fabrication of microstructures on silicon wafers. This process requires physical barriers to confine the electrolyte into a preferred area. In many cases, locations for targeted polishing are inaccessible for conventional polishing heads and localized polishing is difficult to achieve via free-abrasive finishing methods.

As such, a need is recognized for localized finishing and surface modification technologies. For instance, in the case of bio-medical implants, certain areas are required to be rough to facilitate bone ingrowth while other areas are required to be smooth to reduce friction, wear, fatigue, damage, and corrosion. A deterministic and localized polishing method is required for polishing of desired areas without disturbing adjacent rough surfaces.

SUMMARY

The present application relates generally to polishing of surfaces and more particularly, but not by way of limitation, to polishing of freeform external and internal surfaces via manipulation of magnetic-abrasive fluid. In one aspect, the present invention relates to a magnetic field manipulated localized polishing system. The magnetic field manipulated localized polishing system includes a container holding a volume of a magnetic abrasive fluid. The magnetic abrasive fluid contains abrasive particles. A motor is positioned under the container. A magnet is coupled to the motor such that the motor induces rotation of the magnet. A workpiece is suspended in the container.

In another aspect, the present invention relates to a method for magnetic abrasive polishing. The method includes positioning a workpiece in a container. A magnetic abrasive fluid is introduced to a space under the workpiece. The magnetic abrasive fluid is magnetized via a magnet. A resulting magnetic field is varied by rotating the magnet to apply a magnetic field gradient to the workpiece. Travel of magnetic particles present in the magnetic abrasive fluid is induced to affect localized polishing of the workpiece.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1A:
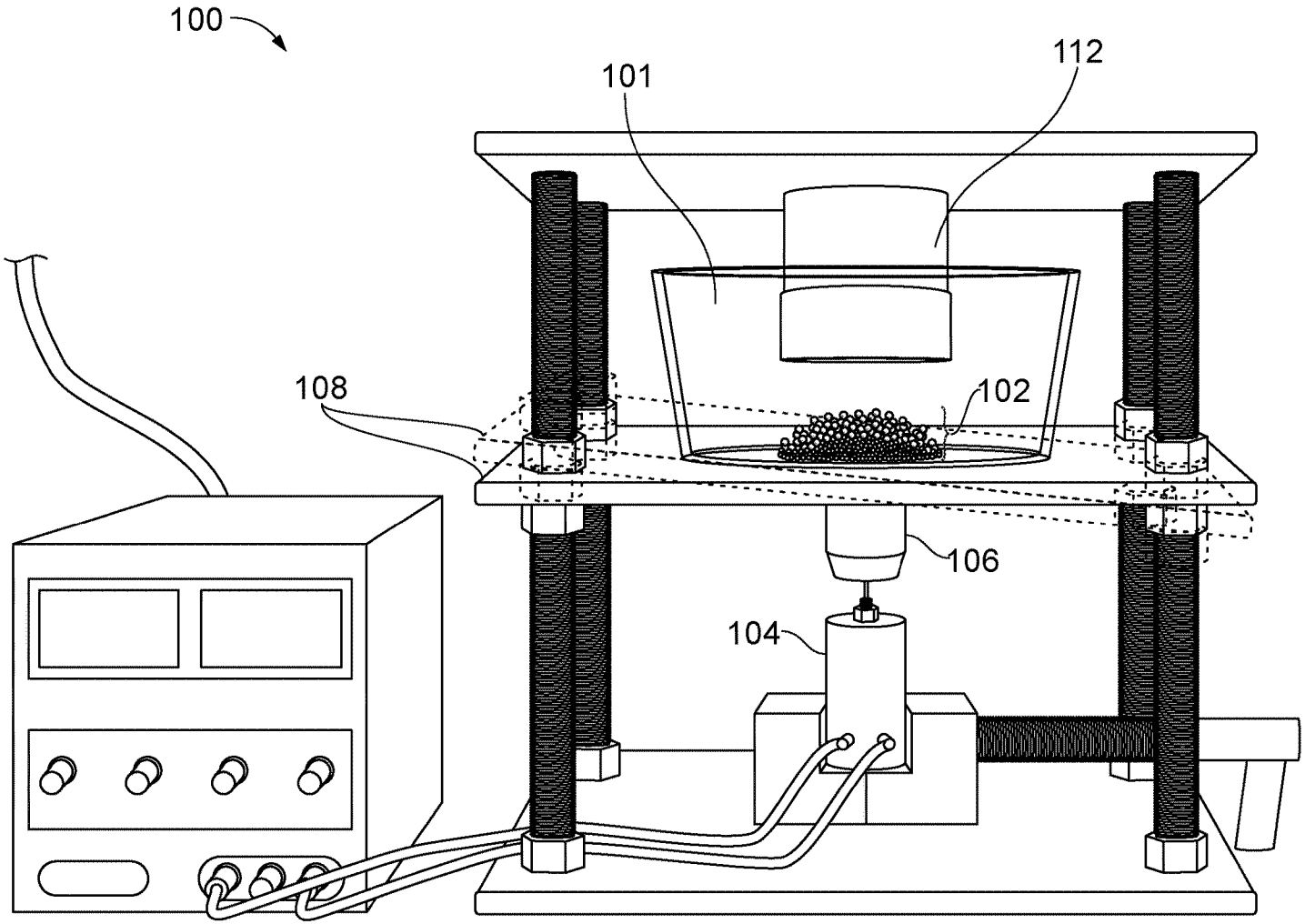
FIG. 1A is a front view of an MFMLP system according to an exemplary embodiment.
Figure 1B:
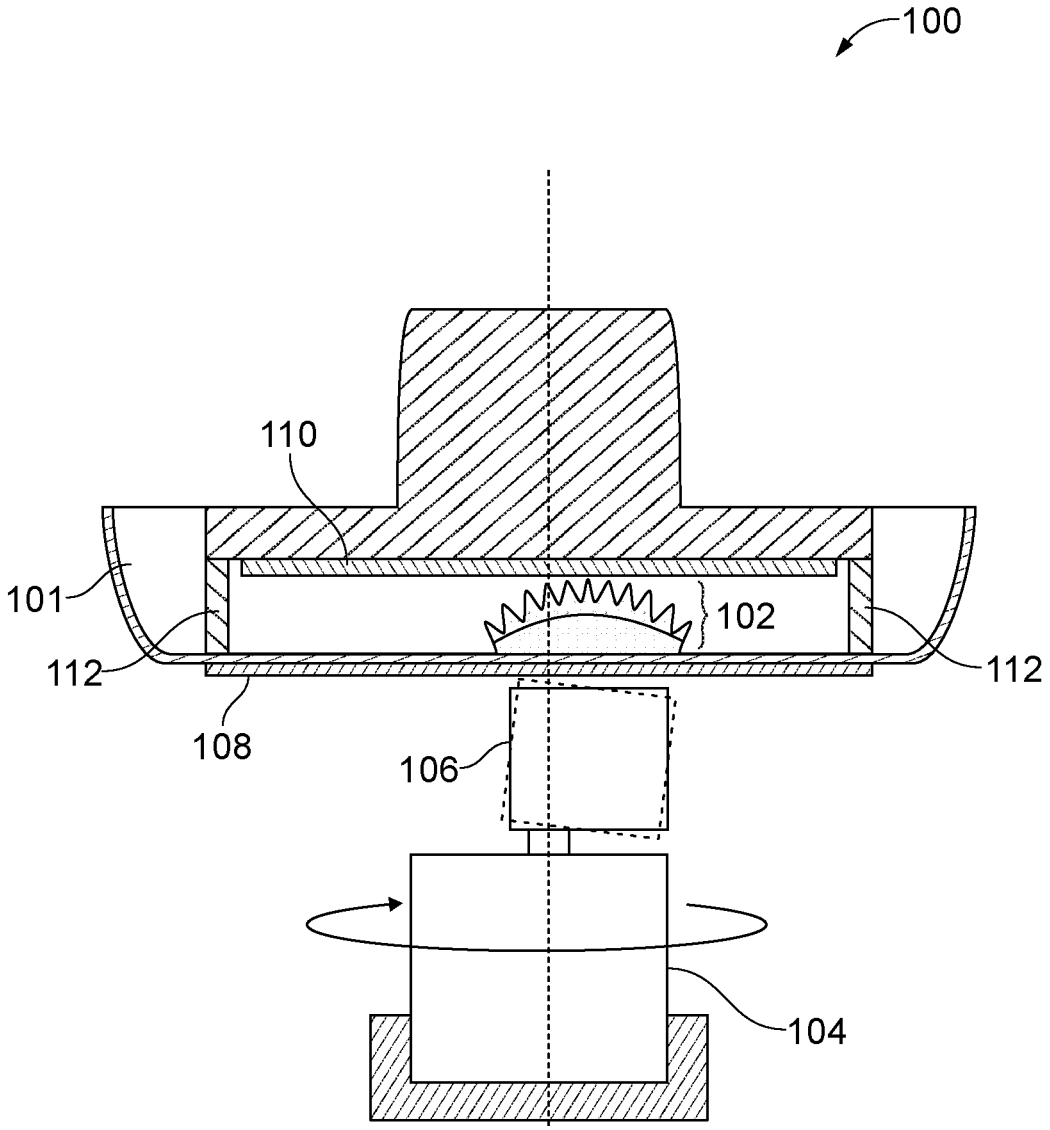
FIG. 1B is a schematic view of the MFMLP system of FIG. 1A according to an exemplary embodiment.

In general, surface polishing of a component has three requirements. First, there must be sufficient contact force between the surface to be polished and the polishing abrasive. Second, there must be relative motion between the surface to be polished and the polishing abrasive. Third, the hardness of the polishing abrasive must be sufficient to overcome the shear modulus of the surface to be polished so as to affect asperity removal. FIG. 1A is a front view of an MFMLP system 100. FIG. 1B is a schematic view of the MFMLP system 100. Referring to FIGS. 1A-1B together, the MFMLP system 100 includes a container 101 that houses a magnetic fluid 102. The MFMLP system 100 also includes a motor 104 disposed below the container 101. The motor 104 is coupled to a magnet 106. In a typical embodiment, the container 101 is sufficiently strong to withstand accidental collision with the magnet 106 and is transparent so as to provide a clear view of the surface being polished. In an exemplary embodiment, the container 101 is constructed from a material such as, for example, soda-lime glass, which is sold under the name PYREX® by Corning, Inc.; however, in other embodiments, other materials could be utilized according to design and application requirements.

Still referring to FIGS. 1A-1B, the magnet 106, in a typical embodiment, is a neodymium (Nd—Fe—B) magnet. As illustrated by way of example in FIGS. 1A-1B, the MFMLP system 100 includes two magnets 106; however, in other embodiments, systems utilizing principles of the invention may utilize any number of magnets. In an exemplary embodiment, the magnet 106 has a magnetic field strength at 5 mm and 10 mm from the surface of the poles of approximately 0.3 T and 0.1 T, respectively. Specifications of an exemplary magnet 106 are listed below in Table 1; however, in other embodiments, magnets of differing types and properties could be utilized according to application and design requirements.

| | |
|---|---|
| Dimensions | 20 mm diameter × 20 mm thick |
| Material | NdFeB |
| Grade | N52 |
| Plating/Coating | Ni—Cu—Ni |
| Magnetization Direction | Axial (Poles aligned on flat ends) |
| Weight | 24.1 g |
| Pull Force | 16.6 lbs |
| Surface Field | 0.64T |
| Maximum Operating Temperature | 176° F. |
| Residual Flux Density ($B_{rmax}$) | 1.32T |

Still referring to FIGS. 1A-1B, in a typical embodiment, the motor 104 is a 3 W motor with a loaded speed of approximately 600 RPM. The magnet 106 is coupled to the motor in such a way that the magnet 106 rotates when power is applied to the motor 104. In a typical embodiment, the magnet 106 is mounted off-center of an axis of rotation of the motor 104. Additionally, the magnet 106 is mounted slightly offset from a vertical axis of the magnet 106. Thus, as the magnet 106 rotates with the motor 104, the magnet 106 traces an approximately conical-shaped pattern. The container 101 is disposed on a platform 108 above the motor 104 and the magnet 106. The platform 108 is inclined at an angle of approximately 5 degrees from horizontal. Due to the increased distance from the container 101 to the magnet 106, such inclination provides a curvilinear variation of a magnetic field of the magnet 106 sufficient to induce agitation of the magnetic fluid 102.

The embodiment described in FIGS. 1A-1B is appropriate for polishing flat or nearly flat concave and convex surfaces. In other embodiments, an array of magnets is disposed in close proximity to the container 101 containing the magnetic fluid 102. Vibration of the magnets produces the spatial and temporal variations in the magnetic field necessary to excite the magnetic fluid 102 and achieve polishing. Such an arrangement is useful for complex surfaces requiring precise location of the polishing material.

Still referring to FIGS. 1A-1B, the magnetic fluid 102 is an abrasive magnetic slurry suspended in a matrix of mineral oil. In a typical embodiment, approximately 20%-40% of the volume of the magnetic fluid 102 includes abrasive particles 202 (shown in FIG. 2A). In an exemplary embodiment, the abrasive particles 202 may be, for example, silicon carbide (SiC) with an average diameter of 15 μm; however, in other embodiments, abrasives of different materials and sizes could be utilized in accordance with application requirements. In a typical embodiment, the magnetic fluid 102 includes, by way of example, ferromagnetic carbonyl iron particles and mineral oil. In other embodiments, surfactants in an amount less than or equal to approximately 5% are included in the magnetic fluid 102. The abrasive particles 202 are suspended in the magnetic fluid 102. In a typical embodiment, the magnetic fluid 102 is characterized as a semisolid fluid.

Still referring to FIGS. 1A-1B, a workpiece 110 having a surface to be polished is suspended in the container 101. A compressible barrier 112 is fitted around a perimeter of the workpiece 110. The workpiece 110 is positioned such that the compressible barrier 112 contacts a bottom interior face of the container 101 thereby creating a sealed region under the workpiece 110 so as to prevent the magnetic fluid 102 from escaping in a lateral direction. The magnetic fluid 102 is introduced to the sealed region. In a typical embodiment, a downward force is applied to the workpiece 110 in an amount sufficient to cause sustained contact between the surface to be polished and the magnetic fluid 102.

Figure 2A:
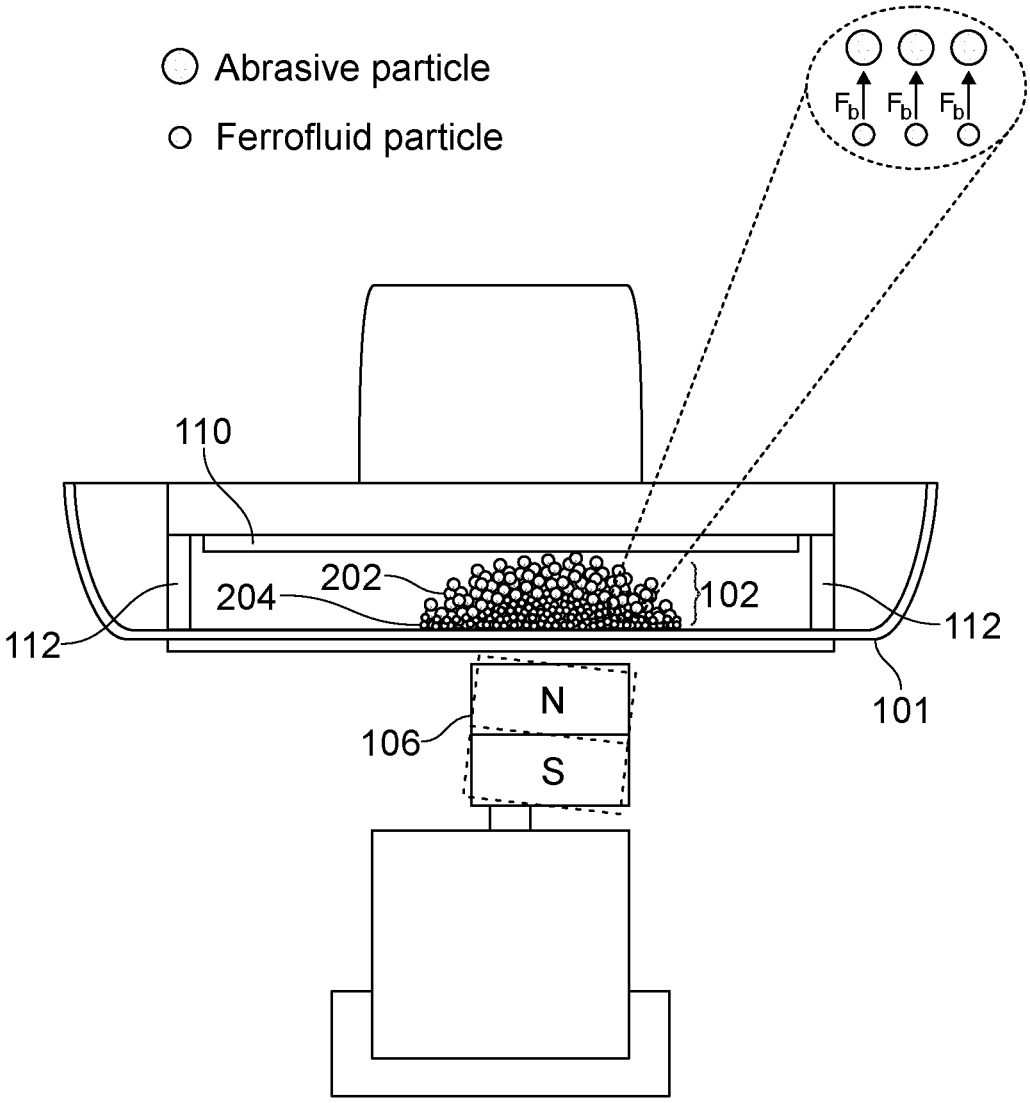
FIG. 2A is a diagrammatic representation of an interface between a magnetic fluid and a workpiece according to an exemplary embodiment.
Figure 2B:
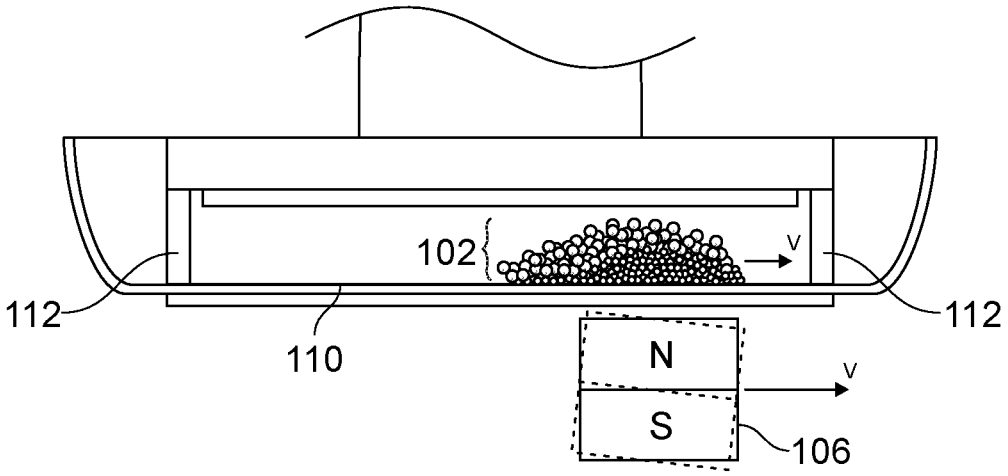
FIG. 2B is a diagrammatic illustration of a magnet acting on a magnetic fluid according to an exemplary embodiment.
Figure 2C:
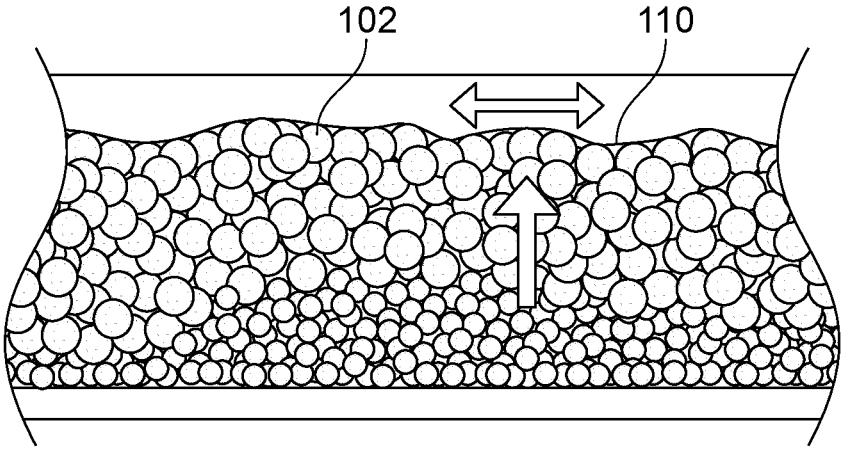
FIG. 2C is a diagrammatic illustration of a magnetic abrasive fluid acting on a workpiece according to an exemplary embodiment.

FIG. 2A is a diagrammatic representation of an interface between a magnetic fluid 102 and the workpiece 110. FIG. 2B is a diagrammatic illustration of the 106 magnet acting on the magnetic fluid 102. FIG. 2C is a diagrammatic illustration of a magnetic abrasive fluid (such as the magnetic fluid 102) acting on the workpiece 110. Referring to FIGS. 2A-2C collectively, during operation, the workpiece 110 is lowered into the container 101 until a gap between the bottom interior face of the container 101 and the surface to be polished is approximately 1 mm. In a typical embodiment, a downward force is applied to the workpiece 110 in an amount sufficient to cause sustained contact between the surface to be polished and the magnetic fluid 102. The magnetic fluid 102 is introduced to the space defined by the compressible barrier 112 underneath the workpiece 110. The magnetic fluid 102 is magnetized by the magnet 106 coupled to the motor 104. A magnetic field of the magnet 106 is varied by rotating the motor 104 and the magnet 106 for a pre-determined polishing time ranging from, for example 10 minutes or less to 60 minutes or more. During polishing, a magnetic field of a specified varying spatio-temporal pattern is applied to the magnetic fluid 102. As shown in FIG. 2B, magnetic particles present in the magnetic fluid 102 will agglomerate in regions of higher magnetic field intensity. Such agglomeration, together with drag exerted by the magnetic fluid 102 itself, will cause the abrasive particles to be carried along the surface of the workpiece 110 thereby causing removal of asperities.

Still referring to FIGS. 2A-2C, the magnetic field gradient causes application of a significant normal force to the workpiece 110. In typical embodiments, the normal force can be the result of mechanical downforce applied to the workpiece 110 or through the pull of magnetic fluid 102 on the surface of the workpiece 110 through the applied magnetic field. Variations in the magnetic field tangent to the surface to be polished cause the magnetic fluid 102 to flow and agitate locally against the workpiece 110. Spatio-temporal variations in the magnetic field, coupled with the flow pattern, determines the stiffness of the polisher. That is, regions of high magnetic-field intensity will expose a greater number of abrasive particles to the workpiece 110 thereby creating a stiffer polishing action. Alternatively, regions of lower magnetic-field intensity will expose fewer number of abrasive particles to the workpiece 110 thereby resulting in a softer polishing action. As shown in FIG. 2C, during polishing, the magnetic fluid 102 is moved laterally or rotated in the vicinity of a targeted area of the workpiece 110 responsive to the desired spatio-temporal distributions of the magnetic field. Application of the magnetic field tends to cause limited separation of the abrasive particles 202 and the magnetic particles 204 present in the magnetic fluid 102. As shown in FIG. 2A, during polishing, the abrasive particles 202 are lifted upwardly towards the workpiece 110 as the magnetic particles 204 are pulled downwardly by the magnet 106. In a typical embodiment, polishing is confined to locations where sufficient normal force exists. After polishing, the workpiece 110 is removed and immersed in a bath of a solvent such as, for example, heptane to dissolve stains resulting from the magnetic fluid 102.

Figure 3:
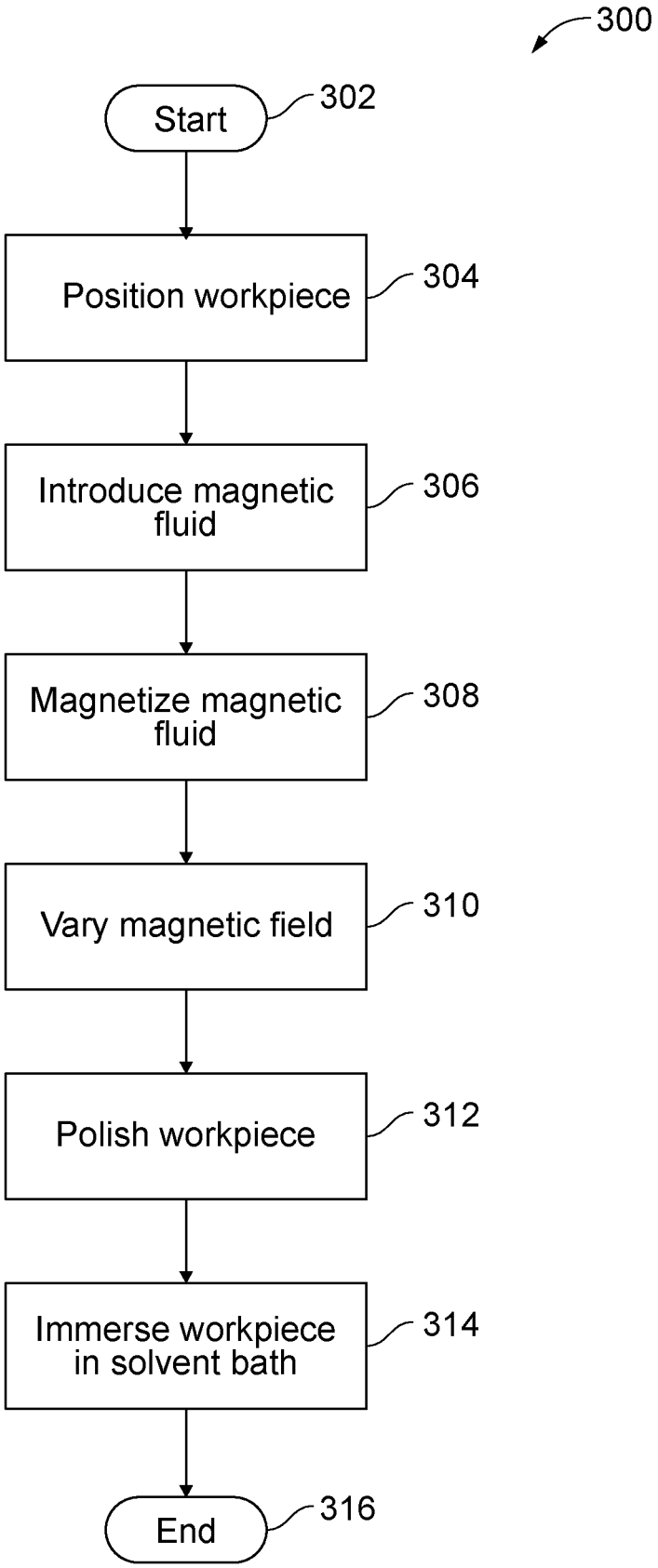
FIG. 3 is a flow diagram illustrating an MFMLP process according to an exemplary embodiment.

FIG. 3 is a flow diagram illustrating an MFMLP process 300 according to an exemplary embodiment. The process 300 begins at step 302. At step 304, the workpiece 110 is positioned in the container 101. At step 306, the magnetic fluid 102 is introduced to a space under the workpiece 110. At step 308, the magnetic fluid 102 is magnetized by the magnet 106. At step 310, a magnetic field of the magnet 106 is varied by rotating the motor 104 and the magnet 106 to apply a magnetic field gradient to the workpiece. At step 312, the magnetic field gradient induces travel of magnetic particles present in the magnetic fluid 102 so as to affect localized polishing of the workpiece 110. At step 314, the workpiece 110 is removed and immersed in a bath of heptane. The process 300 ends at step 316.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A magnetic field manipulated localized polishing system comprising:

a container holding a volume of a magnetic abrasive fluid, the magnetic abrasive fluid containing abrasive particles;

a motor positioned under the container;

a magnet coupled to the motor such that the motor induces rotation of the magnet;

a workpiece suspended in the container;

a compressible barrier having a portion thereof extending downwardly perpendicular to the container, the compressible barrier being spaced apart from a side interior face of the container and positioned around and extending below the workpiece and contacting the container so as to create a sealed region under the workpiece, the magnetic abrasive fluid being contained in the sealed region; and wherein movement of the magnet produces spatial and temporal variations in a magnetic field produced by the magnet that excites the magnetic fluid.

2. The magnetic field manipulated localized polishing system of claim 1, wherein the abrasive particles comprise silicon carbide.

3. The magnetic field manipulated localized polishing system of claim 1, wherein:

the container is positioned on a platform above the motor; and the platform is inclined at an angle relative to horizontal.

4. The magnetic field manipulated localized polishing system of claim 3, wherein inclination of the platform induces curvilinear variation of a magnetic field of the magnet sufficient to induce agitation of the magnetic abrasive fluid.

5. The magnetic field manipulated localized polishing system of claim 1, wherein the magnet is mounted off-center of an axis of rotation of the motor.

6. The magnetic field manipulated localized polishing system of claim 5, wherein the magnet is slightly tilted relative to vertical.

7. The magnetic field manipulated localized polishing system of claim 1, wherein the magnetic abrasive fluid is suspended in mineral oil.

8. The magnetic field manipulated localized polishing system of claim 1, wherein the abrasive particles have a diameter of approximately 15 μm.

9. The magnetic field manipulated localized polishing system of claim 1, wherein the portion extends downwardly perpendicular to a bottom interior face of the container, and wherein the sealed region is formed by the compressible barrier contacting the bottom interior face of the container such that the magnetic abrasive fluid is within the sealed region.

10. A method for magnetic abrasive polishing, the method comprising:

positioning a workpiece in a container;

positioning a compressible barrier having a portion thereof extending downwardly perpendicular to the container around the workpiece, the compressible barrier contacting the container so as to create a sealed region between the workpiece and the container, wherein the compressible barrier is spaced apart from a side interior face of the container and extends below the workpiece;

introducing a magnetic abrasive fluid to a space under the workpiece within the sealed region;

magnetizing the magnetic abrasive fluid via a magnet;

varying a resulting magnetic field by rotating the magnet to apply a magnetic field gradient to the workpiece; and inducing travel of magnetic particles present in the magnetic abrasive fluid, via spatial and temporal variations in the magnetic field, to affect localized polishing of the workpiece.

11. The method of claim 10, comprising removing the workpiece and immersing the workpiece in a bath of a solvent.

12. The method of claim 10, comprising adjusting, via the spatial and the temporal variations in the magnetic field, a stiffness of a polishing action achieved by the magnetic abrasive fluid.

13. The method of claim 12, wherein the magnet is tilted relative to vertical.

14. The method of claim 10, comprising applying a downward force to the workpiece sufficient to cause sustained contact between the workpiece and the magnetic abrasive fluid.

15. The method of claim 10, wherein the magnetic abrasive fluid is moved responsive to variations in the resulting magnetic field.

16. The method of claim 10, wherein a stiffness of a polishing action is varied with the resulting magnetic field.

17. The method of claim 16, wherein the varying the resulting magnetic field causes fewer abrasive particles to be exposed to the workpiece in regions of low magnetic field intensity and a greater number of abrasive particles being exposed to the workpiece in regions of high magnetic field intensity.

18. The method of claim 10, wherein the portion extends downwardly perpendicular to a bottom interior face of the container, and wherein the sealed region is formed by the compressible barrier contacting the bottom interior face of the container such that the magnetic abrasive fluid is within the sealed region.

* * * * *